US008725028B2

(12) United States Patent
Imai

(10) Patent No.: US 8,725,028 B2
(45) Date of Patent: May 13, 2014

(54) IMAGE FORMING APPARATUS USING EXPOSURE UNIT OF PRINT HEAD SYSTEM

(75) Inventor: Shigeaki Imai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 366 days.

(21) Appl. No.: 13/179,014

(22) Filed: Jul. 8, 2011

(65) Prior Publication Data

US 2012/0027450 A1 Feb. 2, 2012

(30) Foreign Application Priority Data

Jul. 27, 2010 (JP) ..... 2010-168713

(51) Int. Cl.
*G03G 21/00* (2006.01)

(52) U.S. Cl.
USPC ..... 399/98

(58) Field of Classification Search
USPC ..... 399/98, 146, 177, 201
See application file for complete search history.

(56) References Cited

U.S. PATENT DOCUMENTS

| | | | | |
|---|---|---|---|---|
| 6,813,051 | B2 | 11/2004 | Suzuki et al. | |
| 7,277,212 | B2 | 10/2007 | Miyatake et al. | |
| 7,397,492 | B2 | 7/2008 | Yamagata | |
| 7,414,644 | B2 | 8/2008 | Yamagata | |
| 7,564,607 | B2 | 7/2009 | Imai | |
| 7,619,796 | B2 | 11/2009 | Imai | |
| 7,643,046 | B2 | 1/2010 | Imai et al. | |
| 7,728,863 | B2 | 6/2010 | Miyatake et al. | |
| 7,751,107 | B2 | 7/2010 | Imai | |
| 7,755,822 | B2 | 7/2010 | Imai | |
| 7,859,732 | B2 | 12/2010 | Imai | |
| 2005/0190420 | A1 | 9/2005 | Imai et al. | |
| 2006/0158711 | A1 | 7/2006 | Imai et al. | |
| 2007/0047004 | A1* | 3/2007 | Sakurai | 358/302 |
| 2007/0058255 | A1 | 3/2007 | Imai et al. | |
| 2008/0019255 | A1 | 1/2008 | Imai et al. | |
| 2008/0068678 | A1 | 3/2008 | Suzuki et al. | |
| 2008/0192323 | A1 | 8/2008 | Nakamura et al. | |
| 2008/0205951 | A1* | 8/2008 | Ueda et al. | 399/345 |
| 2009/0058979 | A1 | 3/2009 | Saisho et al. | |
| 2009/0074437 | A1 | 3/2009 | Tanabe et al. | |
| 2009/0080938 | A1* | 3/2009 | Nagamine | 399/177 |
| 2009/0225385 | A1 | 9/2009 | Imai | |
| 2009/0269102 | A1* | 10/2009 | Kaneko et al. | 399/123 |
| 2010/0310284 | A1 | 12/2010 | Funato et al. | |

FOREIGN PATENT DOCUMENTS

| | | |
|---|---|---|
| JP | 4207767 | 10/2008 |
| JP | 4530588 | 6/2010 |

* cited by examiner

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus includes: an image carrier unit that includes an image carrier that is to be rotated about a rotational driving shaft; a charging unit; an exposing unit including a light source substrate and a lens array; a developing unit; a transfer unit; and a fixing unit. The image carrier unit can be pulled out along the rotational driving shaft of the image carrier. The exposing unit is movable between a contacting position, at which the exposing unit abuts on a contacting surface of the image carrier unit to be positioned relative to the image carrier, and a retracted position, at which the exposing unit is away from the image carrier unit. At the contacting position, the contacting surface is closer to the exposing unit in an optical axial direction than a surface of the lens array is.

12 Claims, 10 Drawing Sheets

IMAGE FORMING APPARATUS USING EXPOSURE UNIT OF PRINT HEAD SYSTEM

CROSS-REFERENCE TO RELATED APPLICATIONS

The present application claims priority to and incorporates by reference the entire contents of Japanese Patent Application No. 2010-168713 filed in Japan on Jul. 27, 2010.

BACKGROUND OF THE INVENTION

1. Field of the Invention

The present invention relates to image forming apparatuses, for use in digital copying machines, laser printers, laser facsimiles, and the like, that form images by what is called as electrophotographic method. More particularly, the invention relates to image forming apparatuses suitable for forming multi-color images.

2. Description of the Related Art

An electrophotographic image forming apparatus for use in a digital copying machine, a laser printer, a laser facsimile, or the like includes a photosensitive element serving as an image carrier and an exposing device for writing image information onto the photosensitive element. An exposing device of this type typically uses a print head that includes a linear light source, such as a light-emitting diode (LED) array or an organic electroluminescence (EL) array, and a rod lens array that guides light emitted from the light source. Example methods for use by the exposing device include, in addition to such a method that uses a print head as discussed above, a laser diode (LD) (semiconductor laser) raster method that uses a semiconductor laser and a polygon scanner; however, in terms of downsizing of apparatus, the method using a print head is more advantageous. Downsizing of laser printers and digital copying machines can be achieved with this method. However, the print head discussed above has a considerably small focal depth of approximately 100 μm; accordingly, a necessity of positioning the print head and a photosensitive element, which is an image carrier, at a given distance from each other with high accuracy arises.

Furthermore, the print head should preferably be located in close proximity of approximately several millimeters to the photosensitive element. This makes a surface of a rod lens array be prone to toner stain. This propensity is particularly pronounced when the LED head is situated upward (in an orientation where light travels upward). Accordingly, to use such a print head, a cleaning mechanism for cleaning the surface of the rod lens array and the like should preferably be used.

The cleaning mechanism for cleaning the surface of the rod lens array and a positioning mechanism for positioning the print head and the photosensitive element, which is the image carrier, at a given distance from each other with high accuracy as discussed above are closely related to each other; hence, it is necessary to deal with these mechanisms linked with each other.

For instance, a configuration for holding a print head and a photosensitive drum, serving as an image carrier, at a given distance from each other by brining a positioning pin projecting from the print head into contact with a periphery of a shaft of the photosensitive drum is disclosed in Japanese Patent Application Laid-open No. 2005-178006 or the like. Such a configuration positions the print head and the photosensitive drum at the given distance from each other with high accuracy.

A configuration that holds a print head and a photosensitive element at a given distance from each other with rollers is disclosed in, for instance, Japanese Patent Application Laid-open No. 2003-39732.

As described above, in Japanese Patent Application Laid-open No. 2005-178006 disclosed is the configuration of holding the print head and the photosensitive drum, which is the image carrier, at a given distance by brining the positioning pin projecting from the print head into contact with the periphery of the shaft of the photosensitive drum. Disclosed in Japanese Patent Application Laid-open No. 2003-39732 is the configuration that holds the print head and the photosensitive element at a given distance from each other with the rollers.

However, with the configuration of Japanese Patent Application Laid-open No. 2005-178006, a surface of a lens array of the print head is to be cleaned by inserting a cleaning member from outside. The positioning pin can be an obstacle interfering with the cleaning member on an insertion path of the cleaning member by, for instance, coming into contact with the positioning pin when the cleaning member is inserted. This can result in failure of insertion of the cleaning member or complicated insertion process. Furthermore, replacement of the photosensitive drum is performed by drawing out the photosensitive drum in a direction parallel to an axial direction of the photosensitive drum (the LED print head is not replaced). While the photosensitive drum is being drawn out, the positioning pin can contact a surface of the photosensitive drum. To avoid this, it is necessary to retract the LED print head by a large amount, which can result in an increase in overall size (due to the large retraction amount) and an increase in complexity of a retracting mechanism.

The configuration of Japanese Patent Application Laid-open No. 2003-39732 is also less preferable in that when the cleaning member is inserted from outside to perform cleaning, the rollers can interfere with the cleaning member, thereby preventing insertion of the cleaning member or making an insertion process complicated.

SUMMARY OF THE INVENTION

It is an object of the present invention to at least partially solve the problems in the conventional technology.

According to an aspect of the present invention, there is provided an image forming apparatus including: an image carrier unit including a cylindrical image carrier that is to be rotated about a cylinder axis; a charging unit for charging the image carrier, thereby causing the image carrier to be charged; an exposing unit for forming an electrostatic latent image on the image carrier charged by the charging unit, the exposing unit including a light source substrate that includes light sources arranged in at least one line and a lens array that guides light emitted from the light sources; a developing unit for developing the electrostatic latent image on the image carrier formed by the exposing unit with toner; a transfer unit for transferring the image developed on the image carrier onto an image recording medium; and a fixing unit for fixing the image transferred by the transfer unit onto the recording medium, wherein the image carrier unit can be drawn in a direction parallel to the rotational driving shaft of the image carrier, the exposing unit is movable between a contacting position, at which the exposing unit is supported by an image forming apparatus body and the exposing unit comes into contact with a contacting surface of the image carrier unit to be positioned at a predetermined position relative to the image carrier, and a retracted position, at which the exposing unit is away from the image carrier unit, and the contacting surface of the image carrier unit at the contacting position is closer to the exposing unit in an optical axial direction than a surface of the lens array is.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments are described in detail below with reference to the accompanying drawings.

Figure 1:
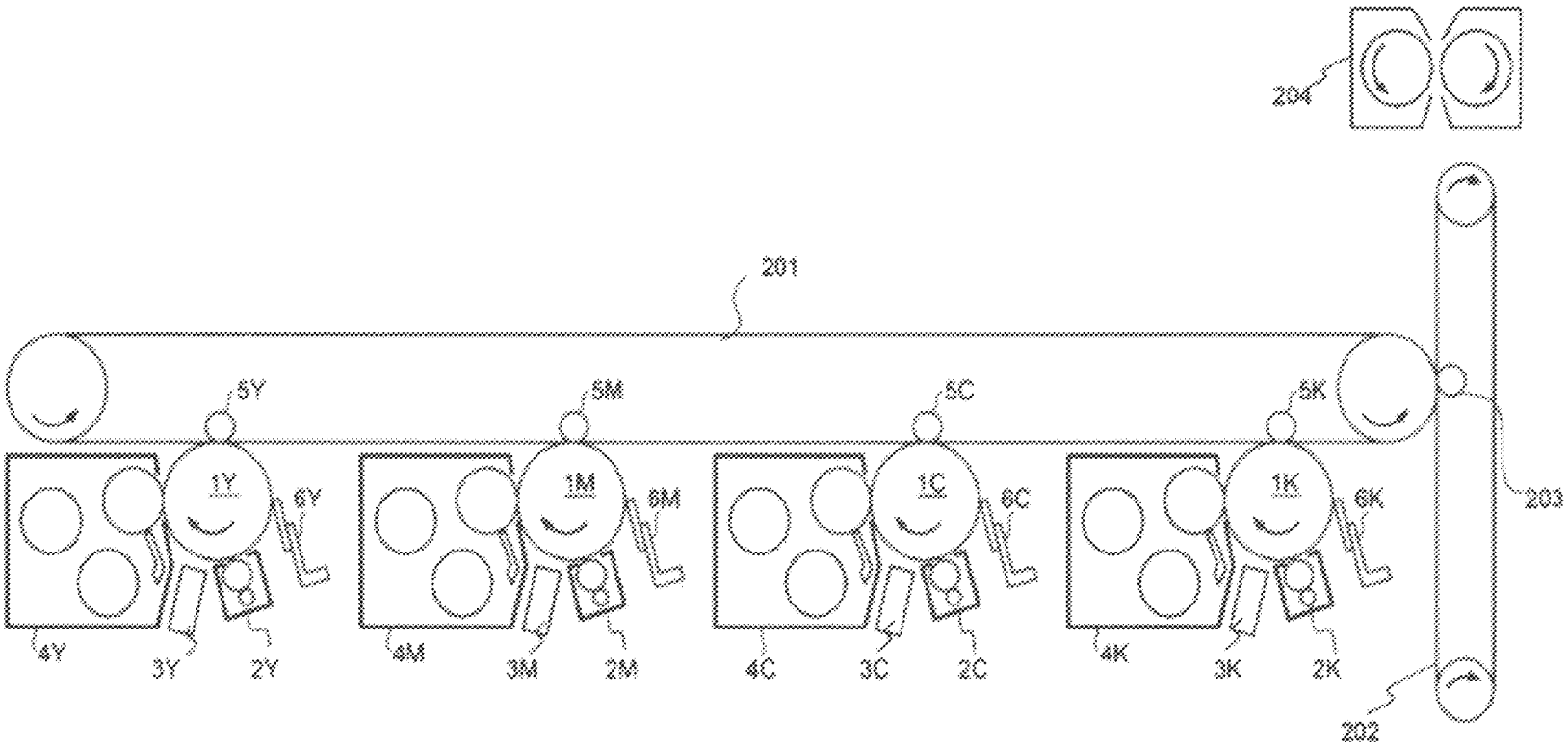
FIG. 1 is a schematic diagram illustrating configurations of relevant portions of an image forming apparatus for use in forming multi-color images according to a first embodiment.
Figure 2:
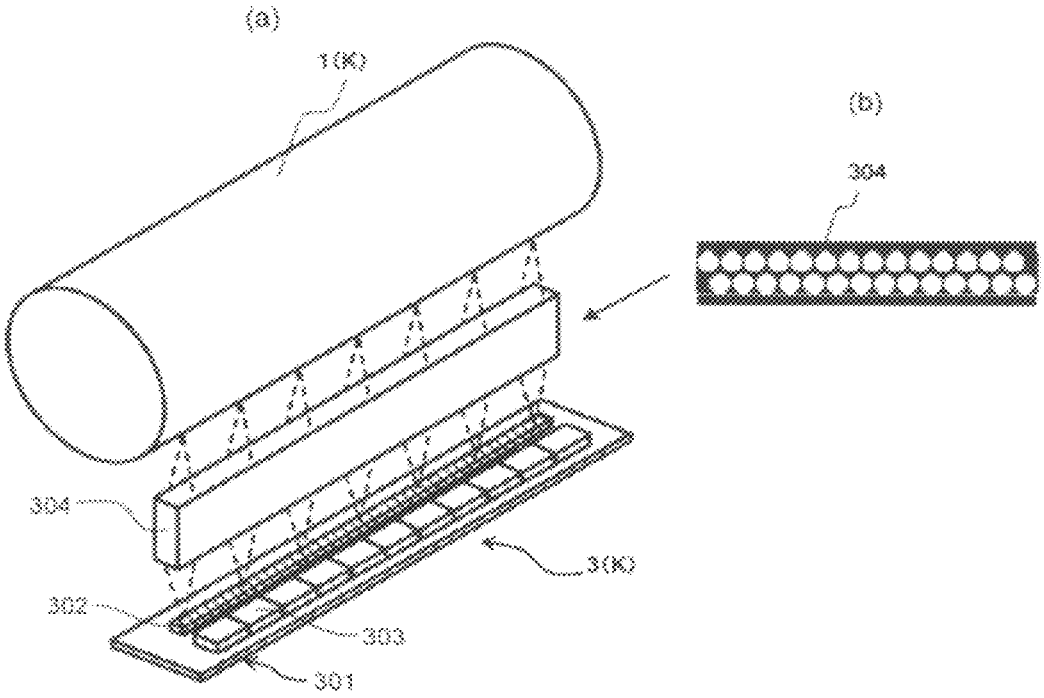
FIG. 2 is an explanatory diagram of the configuration of a print head in the image forming apparatus illustrated in FIG. 1, FIG. 2(*a*) being a perspective view schematically illustrating a photosensitive element and the print head, FIG. 2(*b*) being a schematic diagram illustrating an arrangement of a rod lens array of the print head.
Figure 3:
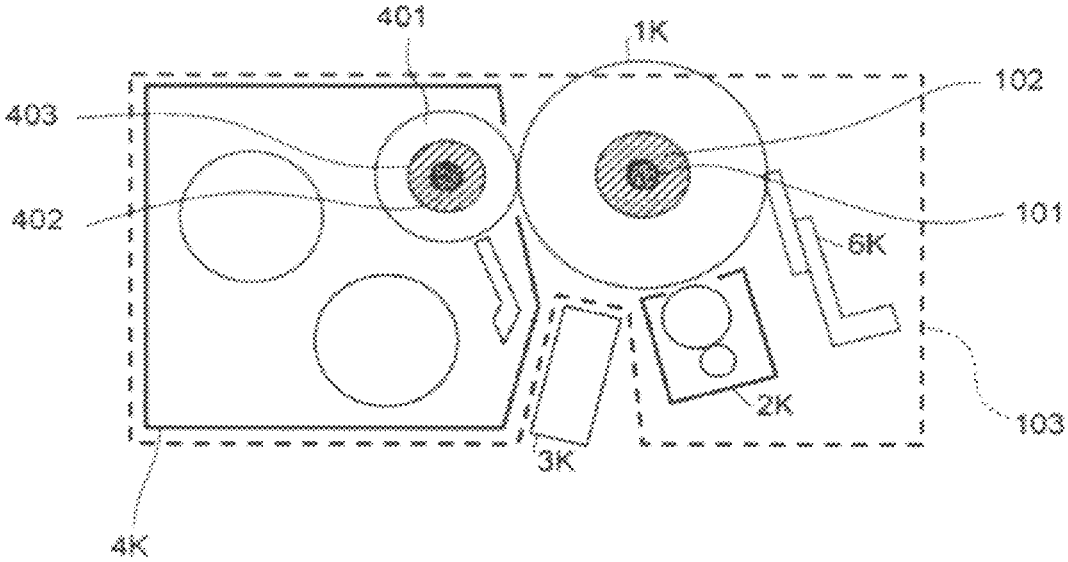
FIG. 3 is a schematic diagram illustrating a layout of units near and around the photosensitive element of the image forming apparatus illustrated in FIG. 1.
Figure 4:
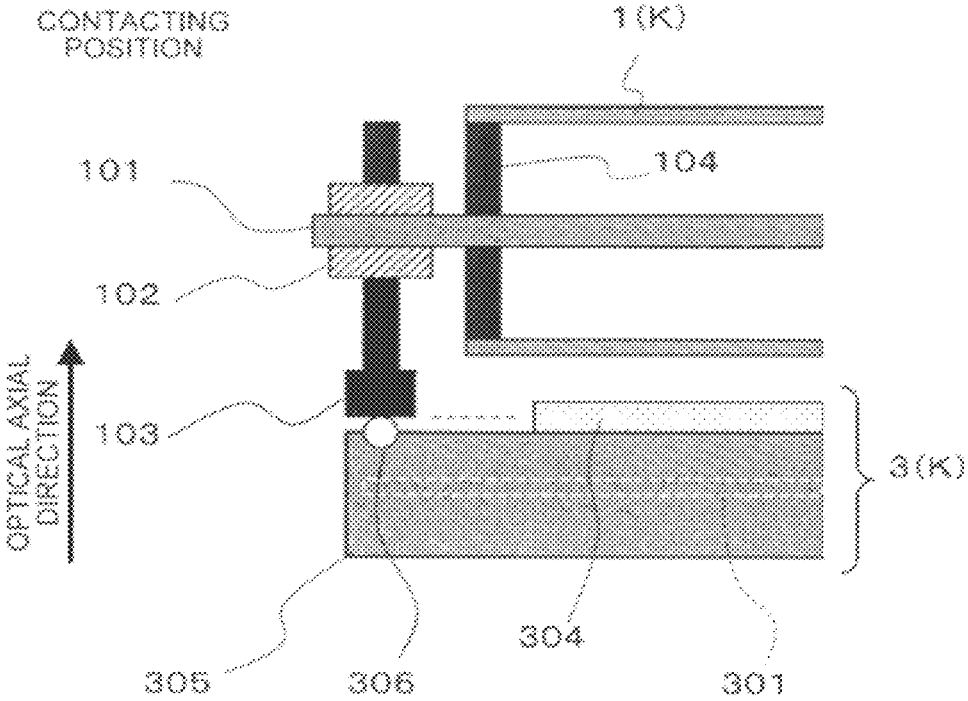
FIG. 4 is a schematic cross-sectional view illustrating an arrangement of relevant portions of the photosensitive element and the print head of the image forming apparatus illustrated in FIG. 1 in a state where the print head is at a contacting position.
Figure 5:
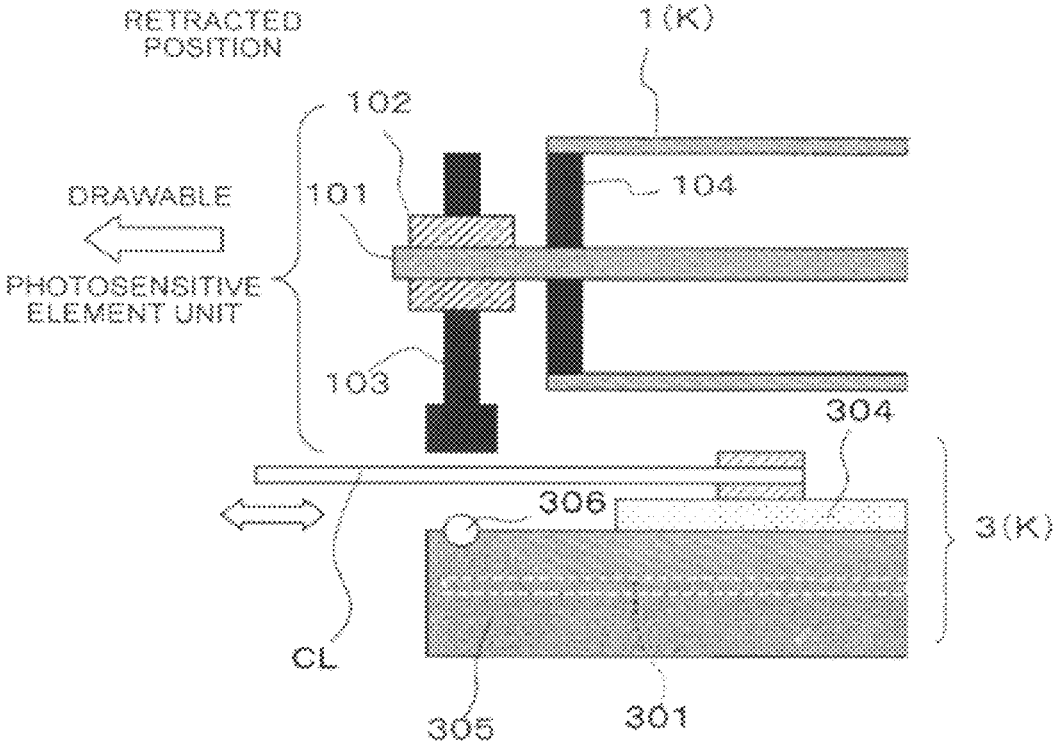
FIG. 5 is a schematic cross-sectional view illustrating an arrangement of the relevant portions of the photosensitive element and the print head of the image forming apparatus illustrated in FIG. 4 in a state where the print head is at a retracted position.

FIGS. 1 through 5 illustrate the configuration of an image forming apparatus according to a first embodiment. FIG. 1 is a schematic diagram illustrating configurations of relevant portions of what is called as a tandem multi-color image forming apparatus, an example application of the image forming apparatus according to the first embodiment to a multi-color system. FIG. 2 is an explanatory diagram of the configuration of a print head of the multi-color image forming apparatus illustrated in FIG. 1. FIG. 2(*a*) is a perspective view schematically illustrating a photosensitive element and the print head. FIG. 2(*b*) is a schematic diagram illustrating an arrangement of a rod lens array of the print head. FIG. 3 is a schematic diagram illustrating a layout of units near and around the photosensitive element of the multi-color image forming apparatus illustrated in FIG. 1. FIG. 4 is a schematic cross-sectional view illustrating an arrangement of relevant portions of the photosensitive element and the print head of the multi-color image forming apparatus illustrated in FIG. 1 in a state where the print head is at a contacting position. FIG. 5 is a schematic cross-sectional view illustrating an arrangement of the relevant portions of the photosensitive element and the print head of the multi-color image forming apparatus illustrated in FIG. 4 in a state where the print head is at a retracted position.

The multi-color image forming apparatus illustrated in FIGS. 1 through 5 includes photosensitive elements 1 (1Y, 1M, 1C, and 1K), charging devices 2 (2Y, 2M, 2C, and 2K), print heads 3 (3Y, 3M, 3C, and 3K), developing devices 4 (4Y, 4M, 4C, and 4K), transfer rollers 5 (5Y, 5M, 5C, and 5K), and cleaning units 6 (6Y, 6M, 6C, and 6K). These units form stations for different colors, or, more specifically, yellow, magenta, cyan, and black. The stations are similar to one another in configuration. Suffix symbols Y, M, C, and K denote yellow, magenta, cyan, and black, respectively. An element, to which suffix Y, M, C, or K is not attached, is any one of an element that is not provided for each of the colors but used in a shared manner among the colors and an element of an example color of elements provided for each of the colors. The multi-color image forming apparatus illustrated in FIGS. 1 through 5 further includes an intermediate transfer belt 201, a conveying belt 202, a secondary transfer roller 203, and a fixing device 204 that are used in a shared manner among the four colors.

The multi-color image forming apparatus illustrated in FIGS. 1 through 5 further includes a photosensitive-element rotating shaft 101, a photosensitive-element-shaft bearing member 102, a shaft-bearing holding member 103, a photosensitive-element inner member 104, a developing-roller 401, a developing-roller rotating shaft 402, a developing-roller-shaft bearing member 403, a light source substrate 301, an LED array 302, an LED driving unit 303, a lens array 304, a head holder 305, and a spacing member 306. These members and the like are provided for each of the colors in a similar manner. Although FIGS. 2 to 5 illustrate a configuration for black (K) as an example, configurations for the other colors are similar thereto.

Referring to FIG. 1, the drum-shaped photosensitive elements 1Y, 1M, 1C, and 1K serving as image carriers for yellow, magenta, cyan, and black, respectively, rotate clockwise in FIG. 1, or in a direction indicated by arrows in photosensitive element of FIG. 1. Along this rotating direction, corresponding ones of the charging devices 2Y, 2M, 2C, and 2K each serving as a charging unit, the print heads 3Y, 3M, 3C, and 3K each serving as an exposing unit, the developing devices 4Y, 4M, 4C, and 4K each serving as a developing unit, the transfer rollers 5Y, 5M, 5C, and 5K each serving as a transfer charging unit, and the cleaning units 6Y, 6M, 6C, and 6K are provided around each of the photosensitive elements 1Y, 1M, 1C, and 1K.

The charging devices 2Y, 2M, 2C, and 2K are the charging units that cause outer peripheral surfaces of the photosensitive elements 1Y, 1M, 1C, and 1K to be uniformly electrostatically charged. Although FIG. 1 illustrates an example where a method that uses charging rollers is employed, employable method is not limited thereto. After having been electrostatically charged, the photosensitive elements 1Y, 1M, 1C, and 1K are exposed by the print heads 3Y, 3M, 3C, and 3K, which are the exposing units. As a result, electrostatic latent images are formed on the outer peripheral surfaces of the photosensitive elements 1Y, 1M, 1C, and 1K. The developing devices 4Y, 4M, 4C, and 4K, which are the developing units, develop the electrostatic latent images on the outer peripheral surfaces of the photosensitive elements 1Y, 1M, 1C, and 1K to obtain toner images. The transfer rollers 5Y, 5M, 5C, and 5K apply bias voltage to thereby transfer toner images from the outer peripheral surfaces of the photosensitive elements 1Y, 1M, 1C, and 1K onto the intermediate transfer belt 201 in a manner to overlay the toner images of the four, CMYK colors (C (cyan), M (magenta), Y (yellow), and B (black)) on one another on the intermediate transfer belt 201. Thereafter, a bias voltage is applied to the secondary transfer roller 203, thereby collectively transferring the toner images of the four, CMYK colors onto a recording medium, such as paper, conveyed by the conveying belt 202. The fixing device 204 fixes the toner images of the four, CMYK colors onto the recording medium, such as paper. FIG. 2(*a*) schematically depicts an example station (e.g., the station for black (K)) to illustrate the configuration of the print heads 3 (3Y, 3M, 3C, and 3K). Although FIG. 2(*a*) illustrates the one station (the station for black (K)), the other stations are similar thereto in configuration and configured as is the station illustrated in FIG. 2(*a*).

The LED array 302, which is a set of a plurality of LED chips arranged in a line, is formed on the light source substrate 301. The light source substrate 301 also includes the LED driving unit 303 that includes a plurality of driving circuits formed as, for instance, integrated circuits (ICs) each driving a corresponding one of the LED chips of the LED array 302 and arranged along the LED array 302. The LED driving unit 303 does not necessarily have such a configuration where each of the driving ICs is associated with one of the LED chips of the LED array 302; alternatively, the LED driving unit 303 can be configured such that a single IC is associated with all the LED chips on the LED array 302. The LED array 302 and the LED driving unit 303 are not necessarily mounted on the same, single light source substrate 301; alternatively, the LED array 302 and the LED driving unit 303 can be mounted on different substrates.

Light emitted from the LED chips of the LED array 302 forms an image through the lens array 304 on the outer peripheral surface of the photosensitive element 1 (1Y, 1M, 1C, 1K).

A microlens array or a graded refractive index rod lens (GRIN rod lens) array can be used as the lens array 304, for instance. FIG. 2 illustrates an example where a GRIN rod lens array is used as the lens array 304. As illustrated in FIG. 2(*b*), which is a schematic cross-sectional view of the lens array 304, the rod lens array includes two rows of a number of cylindrical rod lenses arranged at regular pitches in each row such that the rows are staggered only by a half length of the regular pitch between the rod lenses, or, put another way, the plurality of GRIN rod lenses are in a staggered arrangement.

Gaps between the rod lenses are filled with black resin that is opaque to light and supports the rod lens array that is also supported on resin members at two lateral sides of the lens array 304. In the resin members, glass having a linear expansivity similar to that of the rod lenses is suspended.

FIG. 3 illustrates a layout of units near and around the photosensitive element 1 (1Y, 1M, 1C, 1K), which is the image carrier. FIG. 4 illustrates a cross-sectional layout of relevant portions of the photosensitive element 1 (1Y, 1M, 1C, 1K) and the print head 3 (3Y, 3M, 3C, 3K), which is the exposing unit, illustrated in FIG. 3 in a state where the print head 3 (3Y, 3M, 3C, 3K) is at the contacting position. As do FIG. 2, each of FIGS. 3 and 4 illustrates the one station (e.g., the station for black (K)) in detail. The other stations are similar thereto in configuration and configured as is the station illustrated in FIGS. 3 and 4.

The rotating shaft 101 of the cylindrical, or, put another way, drum-shaped, photosensitive element 1 (1K), which serves as the image carrier, is supported by the shaft bearing member 102. The shaft bearing member 102 is supported by the shaft-bearing holding member 103 having such a shape as indicated by broken line in FIG. 3.

Thus, a photosensitive element unit serving as an image carrier unit includes at least the drum-shaped photosensitive element 1 (1K). As illustrated in FIG. 3, the photosensitive element unit includes the photosensitive element 1 (1K), the rotating shaft 101 of the photosensitive element, the shaft bearing member 102 of the photosensitive element, the shaft-bearing holding member 103, and the developing device 4 (4K). The developing device 4 (4K) includes the developing-roller 401, the developing-roller rotating shaft 402, and the developing-roller-shaft bearing member 403. The developing-roller-shaft bearing member 403 that rotatably supports the developing-roller rotating shaft 402 is also supported by the shaft-bearing holding member 103.

An example where the drum-shaped photosensitive element 1 (1K) is used as the image carrier is being described. The photosensitive element 1 (1K) is constructed by supporting, for instance, an aluminum tubing, onto which a photosensitive layer is applied, on the photosensitive-element inner member 104 made of resin. The rotating shaft 101, which is made of metal, of the photosensitive element is fastened to the photosensitive-element inner member 104 and rotatably supported by the shaft bearing member 102 of the photosensitive element. In other words, the photosensitive element 1 (1K) integrally rotates with the rotating shaft 101 of the photosensitive element. The shaft bearing member 102 of the photosensitive element is fastened to the shaft-bearing holding member 103. Any one of a ball bearing and a slide bearing can be used as the shaft bearing member 102.

It is assumed here that a direction, in which light emitted from the print head 3 (3K) travels, is the optical axial direction. As illustrated in FIGS. 4 and 5, the print head 3 (3K) serving as the exposing unit includes the spacing member 306 for adjusting a distance between the print head 3 (3K) and the photosensitive element 1 (1K) in an optical axial direction. The distance between the print head 3 (3K) and the photosensitive element 1 (1K) in the optical axial direction is adjusted by bringing the spacing member 306 into contact with the shaft-bearing holding member 103 of the photosensitive element unit. FIG. 4 illustrates the print head 3 (3K) at a contacting position, at which the spacing member 306 provided on the print head 3 (3K) abuts on the shaft-bearing holding member 103 of the photosensitive element unit, thereby holding the print head 3 (3K) and the photosensitive element 1 (1K) at a predetermined distance from each other. FIG. 5 illustrates the print head 3 (3K) at a retracted position, at which the print head 3 (3K) is away from the shaft-bearing holding member 103 and hence the spacing member 306 is away from the shaft-bearing holding member 103.

In the embodiment, the photosensitive element unit that includes at least the photosensitive element 1 (1K) is configured such that the photosensitive element unit can be drawn out in a direction substantially parallel to a rotational driving shaft of the photosensitive element 1 (1K). The print head 3 (3K) is preferably configured to be movable between the contacting position and the retracted position in this way. The photosensitive element unit is configured such that the photosensitive element unit can be drawn out of an image forming apparatus body in the direction substantially parallel to the rotational driving shaft of the photosensitive element 1 (1K). This allows the photosensitive element 1 (1K) to be replaced by replacing the entire photosensitive element unit.

When the print head 3 (3K) is at the contacting position, a contacting surface of the photosensitive element unit, on which the spacing member 306 of the print head 3 (3K) abuts, is an edge portion of the shaft-bearing holding member 103 and situated to be closer to the print head 3 (3K) (i.e., closer to the light source substrate 301) than a front surface of the lens array 304 of the print head 3 (3K) is.

As illustrated in FIG. 5, when such a configuration is employed, cleaning of the front surface of the lens array 304, which is to be performed by inserting a cleaning member CL from outside, can be performed without insertion of the cleaning member CL being blocked by interference with the spacing member 306 on the print head 3 (3K) at the retracted position.

In regard to drawing out the photosensitive element unit of the image forming apparatus body for replacement, repair, or the like, the photosensitive element unit can be readily drawn out so long as only a condition that the lens array 304 projecting from the print head 3 (3K) toward the photosensitive element unit is located outside of the photosensitive element unit is satisfied. This allows a retraction amount of the print head 3 (3K) to be set to a small value. If this retraction amount be large, a necessity of dedicating a large space in the image forming apparatus to retraction arises, making the overall height of the image forming apparatus body large. In contrast, when the retraction amount of the print head 3 (3K) can be set small as in the first embodiment, the coverall height of the image forming apparatus body can be reduced; furthermore, a retracting mechanism (not shown) can be simplified.

Meanwhile, if the contacting surface where the spacing member 306 of the print head 3 (3K) abuts on the shaft-bearing holding member 103 of the photosensitive element unit is located farther away from the light source substrate 301 and the like of the print head 3 (3K) than the front surface of the lens array 304 is, interference between the cleaning member CL and the spacing member 306 occurs when the cleaning member CL is inserted. This results in a problem that the cleaning member CL cannot be inserted or an operation of inserting the cleaning member CL becomes complicated.

If the contacting surface where the spacing member 306 of the print head 3 (3K) abuts on the shaft-bearing holding member 103 of the photosensitive element unit is located farther away from the print head 3 (3K) than the outer peripheral surface of the photosensitive element 1 (1K) is, a necessity of retracting toward the print head 3 (3K) farther than the outer peripheral surface of the photosensitive element 1 (1K) when drawing out the photosensitive element unit arises, which disadvantageously makes the retraction amount large.

Figure 6:
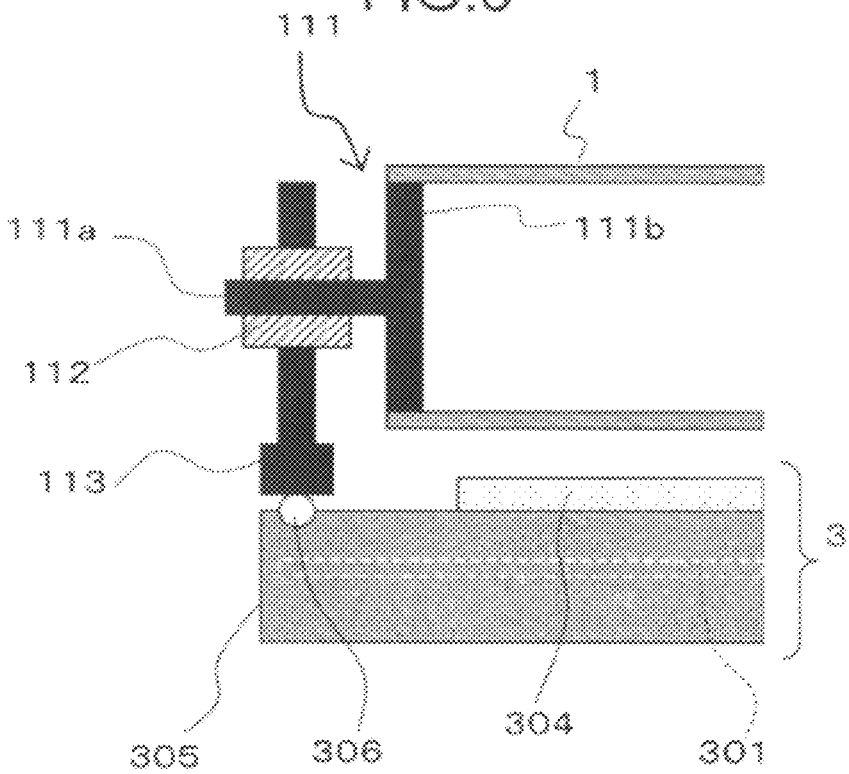
FIG. 6 is a schematic cross-sectional view illustrating an arrangement of relevant portions of the photosensitive element and the print head of an image forming apparatus according to a second embodiment in a state where the print head is at a contacting position.

FIG. 6 is a schematic cross-sectional view illustrating an arrangement of relevant portions of the photosensitive element and the print head of an image forming apparatus according to a second embodiment. Referring to FIG. 6, the photosensitive element 1 (1Y, 1M, 1C, 1K) includes a photosensitive-element rotating-shaft member 111, a photosensitive-element-shaft bearing member 112, and a shaft-bearing holding member 113 that slightly differ from corresponding members illustrated in FIGS. 4 and 5; the print head 3 (3Y, 3M, 3C, 3K) includes the light source substrate 301, the LED array 302, the LED driving unit 303, the lens array 304, the head holder 305, and the spacing member 306 that are similar to those illustrated in FIGS. 4 and 5.

The image forming apparatus according to the second embodiment illustrated in FIG. 6 includes the photosensitive-element rotating-shaft member 111, which is formed by integrating the photosensitive-element rotating shaft 101 and the photosensitive-element inner member 104 illustrated in FIGS. 4 and 5 together. The photosensitive-element rotating-shaft member 111 includes a rod-shaped rotating shaft portion 111*a* that is rotatably supported by the photosensitive-element-shaft bearing member 112 and a disk-shaped interior portion 111*b* that supports an inner peripheral surface of an end portion of the photosensitive element 1.

Figure 7:
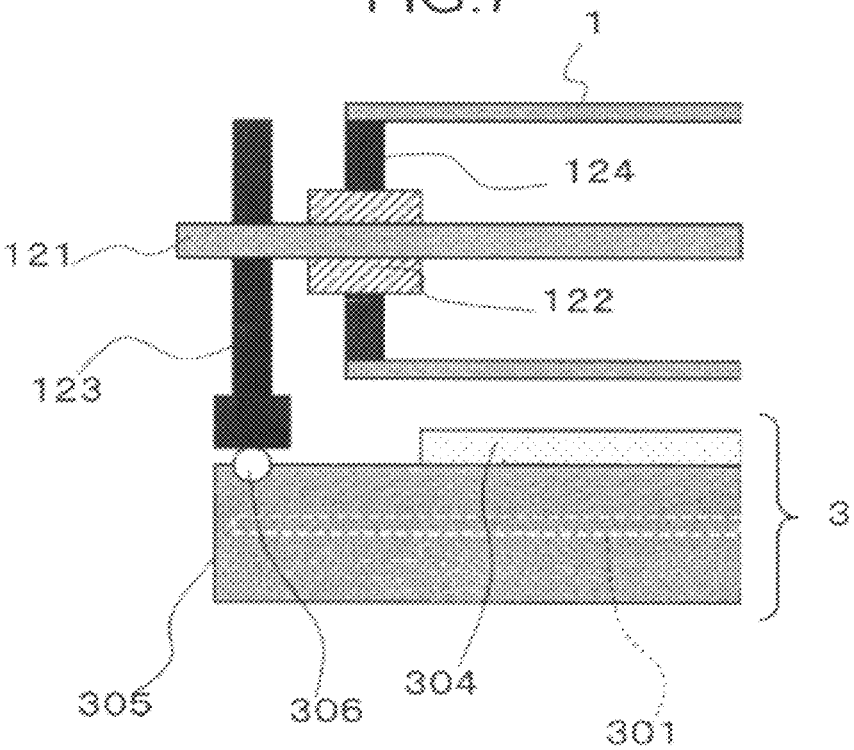
FIG. 7 is a schematic cross-sectional view illustrating an arrangement of relevant portions of the photosensitive element and the print head of an image forming apparatus according to a third embodiment in a state where the print head is at a contacting position.

FIG. 7 is a schematic cross-sectional view illustrating an arrangement of relevant portions of the photosensitive element and the print head of an image forming apparatus according to a third embodiment. Referring to FIG. 7, the photosensitive element 1 (1Y, 1M, 1C, 1K) includes a photosensitive-element rotating shaft 121, a shaft bearing member 122, a rotating-shaft holding member 123, and a photosensitive-element inner member 124 that slightly differ from corresponding members illustrated in FIG. 6; the print head 3 (3Y, 3M, 3C, 3K) includes the light source substrate 301, the LED array 302, the LED driving unit 303, the lens array 304, the head holder 305, and the spacing member 306 that are similar to those illustrated in FIGS. 4 through 6.

In the image forming apparatus according to the third embodiment illustrated in FIG. 7, the shaft bearing member 122 is arranged between the photosensitive-element rotating shaft 121 and the photosensitive-element inner member 124 illustrated in FIGS. 4 and 5; the photosensitive-element rotating shaft 121 is fastened to and supported by the rotating-shaft holding member 123 by, for instance, press-fit insertion. The photosensitive-element inner member 124 is rotatably supported by the photosensitive-element rotating shaft 121 with the shaft bearing member 122 therebetween. The spacing member 306 of the print head 3 (3Y, 3M, 3C, 3K) comes into contact with the rotating-shaft holding member 123 of the photosensitive element 1 (1Y, 1M, 1C, 1K), thereby holding the photosensitive element 1 (1Y, 1M, 1C, 1K) and the print head 3 (3Y, 3M, 3C, 3K) at a given distance from each other at this contacting position.

Figure 8:
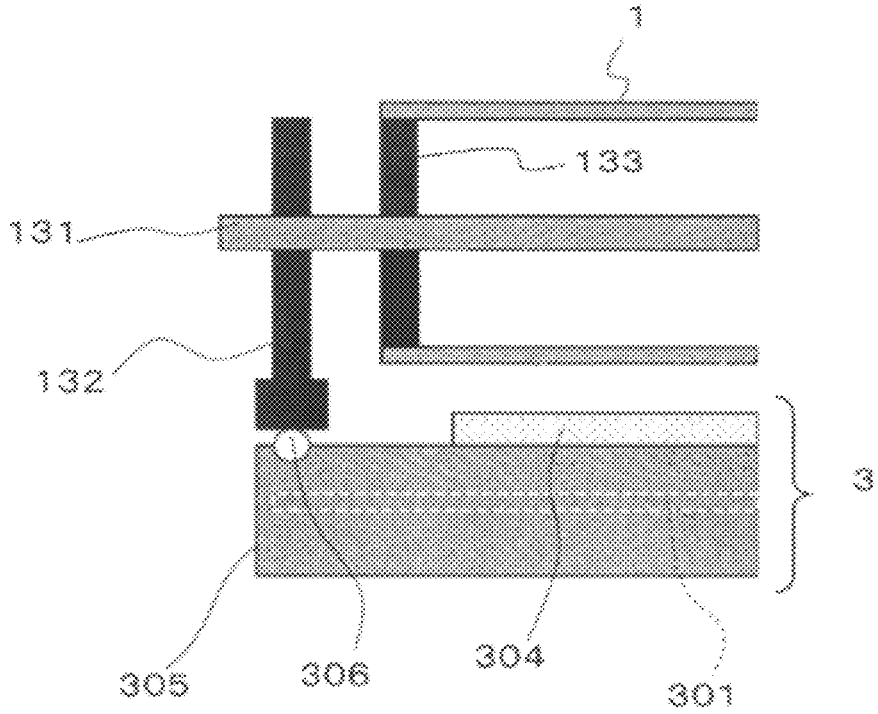
FIG. 8 is a schematic cross-sectional view illustrating an arrangement of relevant portions of the photosensitive element and the print head of an image forming apparatus according to a fourth embodiment in a state where the print head is at a contacting position.

FIG. 8 is a schematic cross-sectional view illustrating an arrangement of relevant portions of the photosensitive element and the print head of an image forming apparatus according to a fourth embodiment. Referring to FIG. 8, the photosensitive element 1 (1Y, 1M, 1C, 1K) includes a photosensitive-element rotating shaft 131, a rotating-shaft holding member 132, and a photosensitive-element inner member 133 that slightly differ from corresponding members illustrated in FIG. 7; the print head 3 (3Y, 3M, 3C, 3K) includes the light source substrate 301, the LED array 302, the LED driving unit 303, the lens array 304, the head holder 305, and the spacing member 306 that are similar to those illustrated in FIGS. 4 through 7.

The image forming apparatus according to the fourth embodiment illustrated in FIG. 8 differs from the image forming apparatus according to the third embodiment illustrated in FIG. 7 in not including the shaft bearing member 122. The image forming apparatus according to the fourth embodiment is configured to rotatably support the photosensitive element 1 (1Y, 1M, 1C, 1K) such that when the photosensitive element 1 (1Y, 1M, 1C, 1K) rotates, the photosensitive-element rotating shaft 131 slides relative to any one of the photosensitive-element inner member 133 and the rotating-shaft holding member 132.

Figure 9:
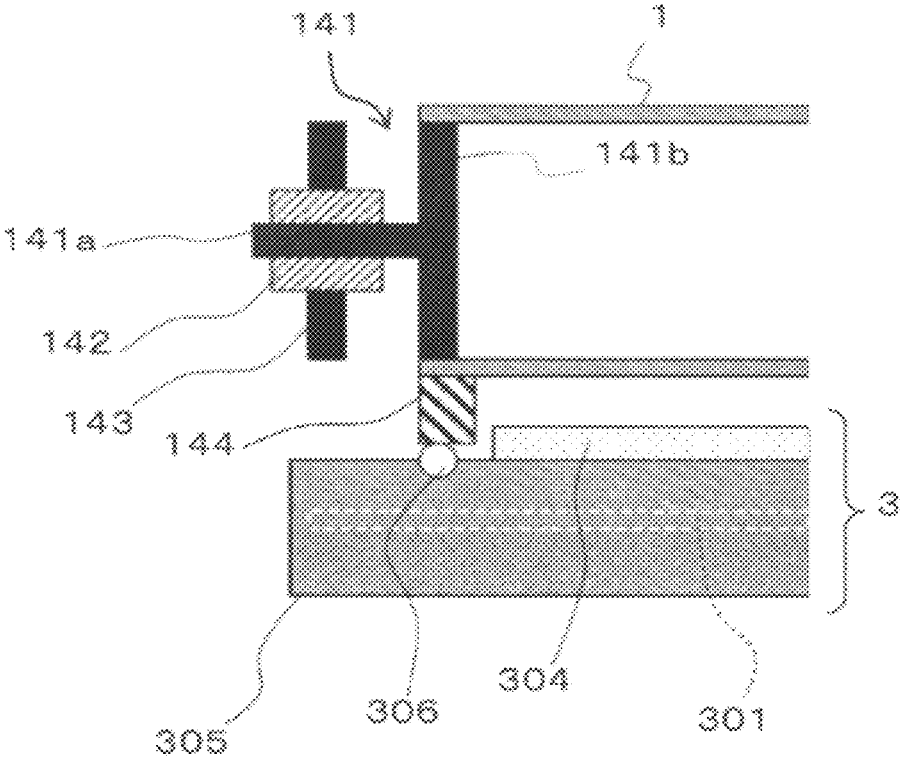
FIG. 9 is a schematic cross-sectional view illustrating an arrangement of relevant portions of the photosensitive element and the print head of an image forming apparatus according to a fifth embodiment in a state where the print head is at a contacting position.

FIG. 9 is a schematic cross-sectional view illustrating an arrangement of relevant portions of the photosensitive element and the print head of an image forming apparatus according to a fifth embodiment. Referring to FIG. 9, the photosensitive element 1 (1Y, 1M, 1C, 1K) includes a photosensitive-element rotating-shaft member 141, a photosensitive-element-shaft bearing member 142, a shaft-bearing holding member 143, and a sliding member 144; the print head 3 (3Y, 3M, 3C, 3K) includes the light source substrate 301, the LED array 302, the LED driving unit 303, the lens array 304, the head holder 305, and the spacing member 306 that are similar to those illustrated in FIGS. 4 through 8.

The image forming apparatus according to the fifth embodiment illustrated in FIG. 9 includes, as does the image forming apparatus illustrated in FIG. 6, the photosensitive-element rotating-shaft member 141, which is formed by integrating the photosensitive-element rotating shaft 101 and the photosensitive-element inner member 104 illustrated in FIGS. 4 and 5 together. The photosensitive-element rotating-shaft member 141 includes a rod-shaped rotating shaft portion 141*a* that is rotatably supported by the photosensitive-element-shaft bearing member 142 and a disk-shaped interior portion 141*b* that supports an inner peripheral surface of an end portion of the photosensitive element 1. In the fifth embodiment, the shaft-bearing holding member 143 does not abut on the spacing member 306. The sliding member 144 comes into sliding contact with an outer peripheral surface of the end portion of the rotating photosensitive element 1 (1Y, 1M, 1C, 1K) and also abuts on the spacing member 306 of the print head 3 (3Y, 3M, 3C, 3K), thereby holding the photosensitive element 1 (1Y, 1M, 1C, 1K) and the print head 3 (3Y, 3M, 3C, 3K) at a given distance from each other. Accordingly, a position of the spacing member 306 in the direction along the rotating shaft slightly differs from that of the configurations illustrated in FIGS. 4 to 8 and corresponds to a position of the sliding member 144.

Figure 10:
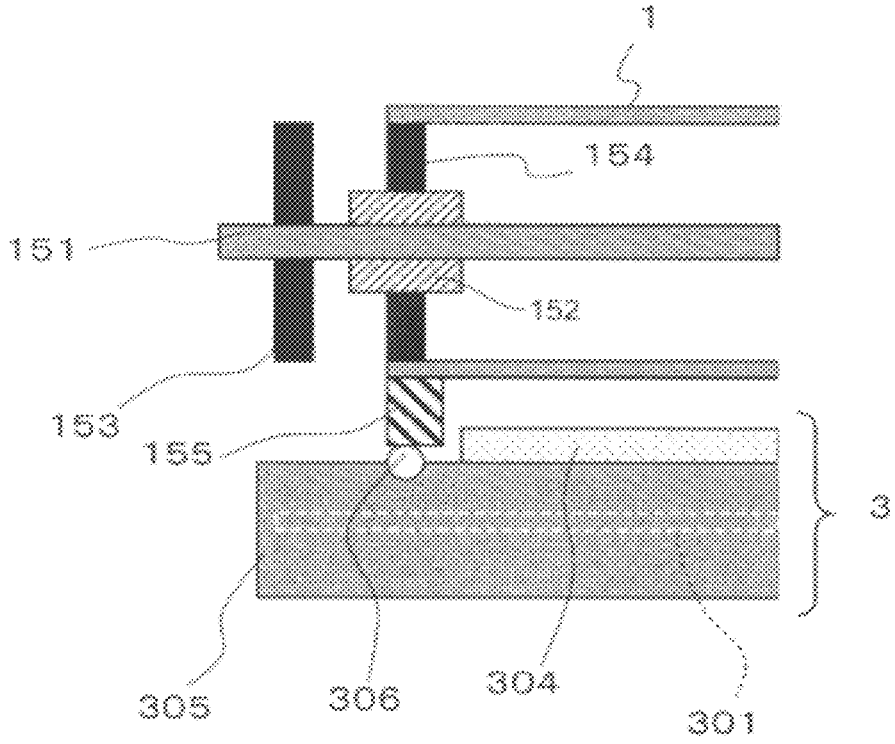
FIG. 10 is a schematic cross-sectional view illustrating an arrangement of relevant portions of the photosensitive element and the print head of an image forming apparatus according to a sixth embodiment in a state where the print head is at a contacting position.

FIG. 10 is a schematic cross-sectional view illustrating an arrangement of relevant portions of the photosensitive element and the print head of an image forming apparatus according to a sixth embodiment. Referring to FIG. 10, the photosensitive element 1 (1Y, 1M, 1C, 1K) includes a photosensitive-element rotating shaft 151, a shaft bearing member 152, a rotating-shaft holding member 153, a photosensitive-element inner member 154, and a sliding member 155; the print head 3 (3Y, 3M, 3C, 3K) includes the light source substrate 301, the LED array 302, the LED driving unit 303, the lens array 304, the head holder 305, and the spacing member 306 that are similar to those illustrated in FIG. 9.

In the image forming apparatus according to the sixth embodiment illustrated in FIG. 10, the shaft bearing member 152 is arranged between the photosensitive-element rotating shaft 151 and the photosensitive-element inner member 154 as does the image forming apparatus illustrated in FIG. 7; the photosensitive-element rotating shaft 151 is fastened to and supported by the rotating-shaft holding member 153 by, for instance, press-fit insertion. The photosensitive-element inner member 154 is rotatably supported by the photosensitive-element rotating shaft 151 with the shaft bearing member 152 therebetween. In the sixth embodiment, the rotating-shaft holding member 153 does not abut on the spacing member 306. Although not specifically illustrated, the rotating-shaft holding member 153 directly or indirectly supports the sliding member 155. The sliding member 155 comes into sliding contact with an outer peripheral surface of the end portion of the rotating photosensitive element 1 (1Y, 1M, 10, 1K) and abuts on the spacing member 306 of the print head 3 (3Y, 3M, 3C, 3K), thereby holding the photosensitive element 1 (1Y, 1M, 10, 1K) and the print head 3 (3Y, 3M, 3C, 3K) at a given distance from each other. Accordingly, a position of the spacing member 306 in the direction along the rotating shaft slightly differs from that of the configurations illustrated in FIGS. 4 to 8 and corresponds to a position of the sliding member 155.

Figure 11:
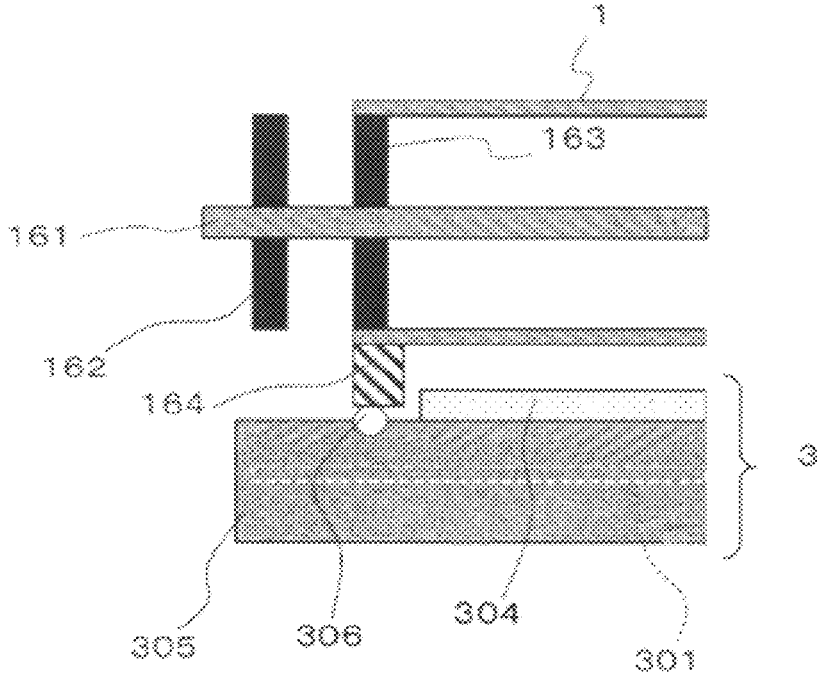
FIG. 11 is a schematic cross-sectional view illustrating an arrangement of relevant portions of the photosensitive element and the print head of an image forming apparatus according to a seventh embodiment in a state where the print head is at a contacting position.

FIG. 11 is a schematic cross-sectional view illustrating an arrangement of relevant portions of the photosensitive element and the print head of an image forming apparatus according to a seventh embodiment. Referring to FIG. 11, the photosensitive element 1 (1Y, 1M, 10, 1K) includes a photosensitive-element rotating shaft 161, a rotating-shaft holding member 162, a photosensitive-element inner member 163, and a sliding member 164; the print head 3 (3Y, 3M, 3C, 3K) includes the light source substrate 301, the LED array 302, the LED driving unit 303, the lens array 304, the head holder 305, and the spacing member 306 that are similar to those illustrated in FIG. 10.

The image forming apparatus according to the seventh embodiment illustrated in FIG. 11 differs from the image forming apparatus according to the sixth embodiment illustrated in FIG. 10 in not including the shaft bearing member 152. The image forming apparatus according to the seventh embodiment is configured to rotatably support the photosensitive element 1 (1Y, 1M, 1C, 1K) such that when the photosensitive element 1 (1Y, 1M, 1C, 1K) rotates, the photosensitive-element rotating shaft 161 slides relative to any one of the photosensitive-element inner member 163 and the rotating-shaft holding member 162. In the seventh embodiment, the rotating-shaft holding member 162 does not abut on the spacing member 306. Although not specifically illustrated, the rotating-shaft holding member 162 directly or indirectly supports the sliding member 164. The sliding member 164 comes into sliding contact with the outer peripheral surface of the end portion of the rotating photosensitive element 1 (1Y, 1M, 1C, 1K) and abuts on the spacing member 306 of the print head 3 (3Y, 3M, 3C, 3K), thereby holding the photosensitive element 1 (1Y, 1M, 1C, 1K) and the print head 3 (3Y, 3M, 3C, 3K) at a given distance from each other. Accordingly, a position of the spacing member 306 in the direction along the rotating shaft slightly differs from that of the configurations illustrated in FIGS. 4 to 8 and corresponds to a position of the sliding member 164.

An image forming apparatus according to an eighth embodiment is described below with reference to FIGS. 12 and 13.

Figure 12:
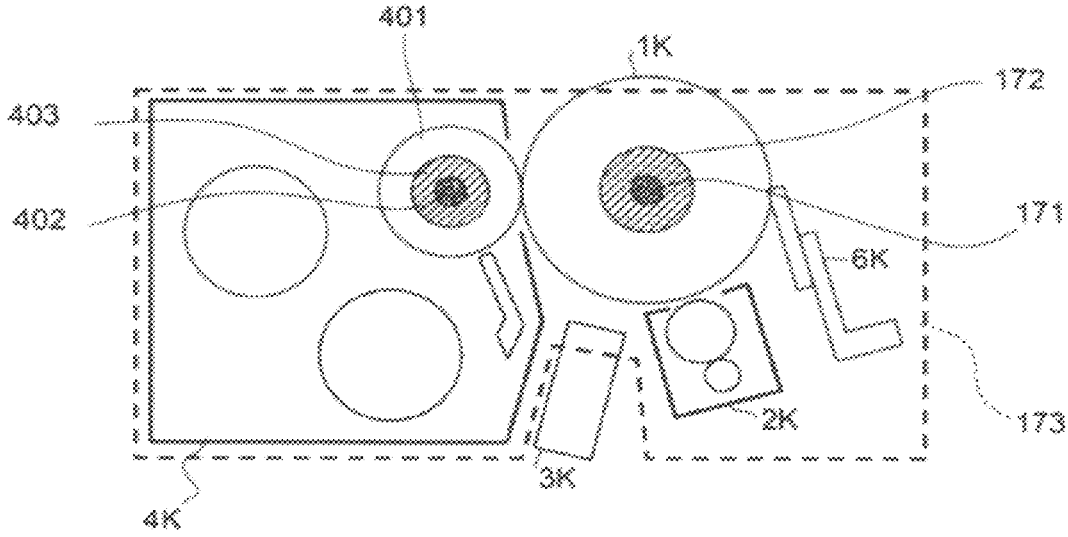
FIG. 12 is a schematic diagram illustrating a layout of units near and around the photosensitive element of an image forming apparatus according to an eighth embodiment.

FIG. 12 illustrates a layout of units near and around the photosensitive element 1 (1Y, 1M, 1C, 1K) according to the eighth embodiment. FIG. 13 illustrates a layout of cross sections of relevant portions of the photosensitive element 1 (1Y, 1M, 1C, 1K) and the print head 3 (3Y, 3M, 3C, 3K), which is the exposing unit, illustrated in FIG. 12 in a state where the print head 3 (3Y, 3M, 3C, 3K) is at the contacting position. Each of FIGS. 12 and 13 schematically depicts the configuration of one station (e.g., the station for black (K)) of the stations illustrated in FIG. 1 in detail. The other stations are similar thereto in configuration and configured as is the station illustrated in FIGS. 12 and 13.

A rotating shaft 171 of the drum-shaped photosensitive element 1 (1K) is supported by a shaft bearing member 172. The shaft bearing member 172 is supported by a shaft-bearing holding member 173 having such a shape as indicated by broken line in FIG. 12.

Thus, a photosensitive element unit serving as an image carrier unit includes at least the drum-shaped photosensitive element 1 (1K). As illustrated in FIGS. 12 and 13, the photosensitive element unit includes the photosensitive element 1 (1K), the rotating shaft 171 of the photosensitive element, the shaft bearing member 172 of the photosensitive element, the shaft-bearing holding member 173, the photosensitive-element inner member 174, and the developing device 4 (4K). The developing device 4 (4K) includes the developing roller 401, the rotating shaft 402 of the developing roller, and the shaft bearing member 403 of the developing roller. The shaft bearing member 403 of the developing roller that rotatably supports the rotating shaft 402 of the developing roller is also supported by the shaft-bearing holding member 173.

The photosensitive element 1 (1K) integrally rotates with the rotating shaft 171 of the photosensitive element. The shaft bearing member 172 of the photosensitive element is fastened to the shaft-bearing holding member 173.

Figure 13:
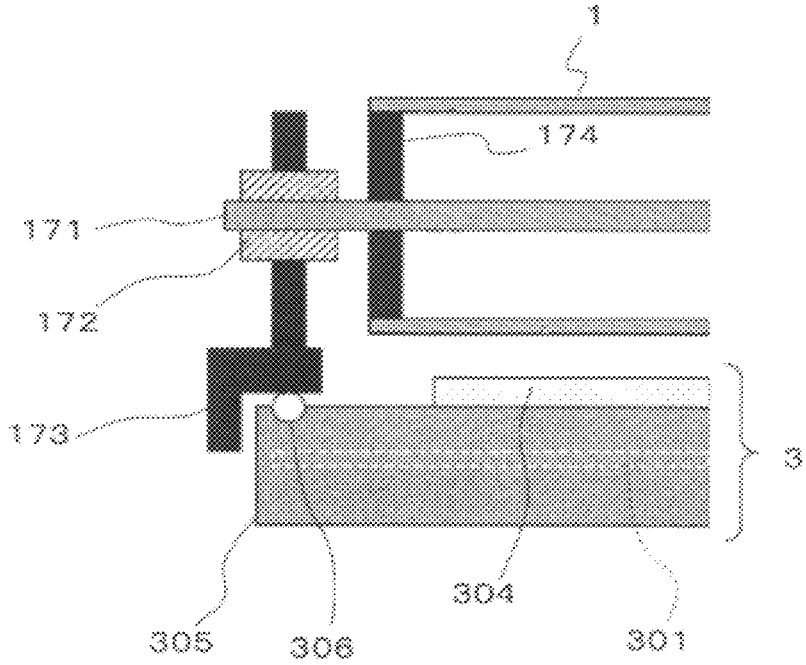
FIG. 13 is a schematic cross-sectional view illustrating an arrangement of relevant portions of the photosensitive element and the print head of the image forming apparatus illustrated in FIG. 12 in a state where the print head is at a contacting position.

As illustrated in FIGS. 12 and 13, in the eighth embodiment, the photosensitive element unit is configured such that when the print head 3 (3K) is at the contacting position, the print head 3 (3K) is inserted into the photosensitive element unit. More specifically, the photosensitive element unit is configured such that the shaft-bearing holding member 173 belonging to the photosensitive element unit covers a portion of the print head 3 (3K) at the contacting position. Configuring the photosensitive element unit in this way increases strength of the photosensitive element unit. In the configuration illustrated in FIGS. 12 and 13, the photosensitive element unit covers the portion of the print head 3 (3K); however, another configuration where the photosensitive element unit covers the entire print head 3 (3K) can alternatively be employed.

In each of the configuration of the image forming apparatus according to the first embodiment illustrated in FIG. 3 and the configuration of the image forming apparatus according to the eighth embodiment illustrated in FIG. 12, the photosensitive element unit also supports the developing device 4 (4Y, 4M, 4C, 4K). More specifically, the shaft-bearing holding member 103 (FIG. 3), 173(FIG. 12) supports the rotating shaft 402 of the developing roller 401 belonging to the developing device 4 (4Y, 4M, 4C, 4K).

It is not requisite that the photosensitive element unit supports the developing device 4 (4Y, 4M, 4C, 4K); however, it is preferable that the photosensitive element unit supports the developing device 4 (4Y, 4M, 4C, 4K). Such a configuration allows the developing roller 401 and the photosensitive element 1 (1Y, 1M, 1C, 1K) to be held stably at a given distance with high accuracy. This leads to provision of images of high image quality free from inconsistencies in density and the like.

In the configurations discussed above, the print head (3Y, 3M, 3C, 3K) is brought into contact with the photosensitive element unit with the spacing member 306 provided on the print head 3 (3Y, 3M, 3C, 3K) therebetween; however, employable configuration is not limited thereto. For instance, the print head 3 (3Y, 3M, 3C, 3K) can be brought into contact with the photosensitive element unit without the spacing member 306 interposed therebetween. However, it is more preferable that the print head 3 (3Y, 3M, 3C, 3K) is brought into contact with the photosensitive element unit with the spacing member 306 provided on the print head 3 (3Y, 3M, 3C, 3K) therebetween and the spacing member 306 adjusts the distance between the print head 3 (3Y, 3M, 3C, 3K) and the photosensitive element 1 (1Y, 1M, 1C, 1K). This configuration allows the photosensitive element 1 (1Y, 1M, 1C, 1K) and the print head 3 (3Y, 3M, 3C, 3K) to be held at a given distance from each other with high accuracy, thereby providing images of high quality.

Figure 14:
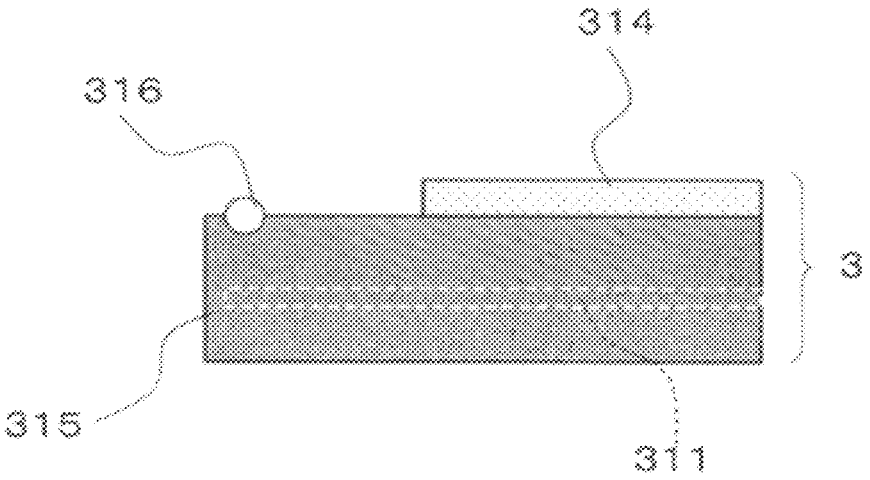
FIG. 14 is a schematic cross-sectional view illustrating an arrangement of an eccentric cam used as a spacing member of the print head of an image forming apparatus according to a ninth embodiment.

FIG. 14 illustrates the configurations of relevant portions of an image forming apparatus according to a ninth embodiment. The print head 3 (3Y, 3M, 3C, 3K) includes a light source substrate 311, a lens array 314, a holder 315, and a spacing member 316. An eccentric cam is used as the spacing member 316. By pivoting the spacing member 316 appropriately, the distance between the print head 3 (3Y, 3M, 3C, 3K) and the photosensitive element 1 (1Y, 1M, 1C, 1K) in a state where the spacing member 316 abuts on the photosensitive element 1 (1Y, 1M, 1C, 1K) is adjusted; thereafter, the spacing member 316 is fastened to the print head 3 (3Y, 3M, 3C, 3K).

Figure 15:
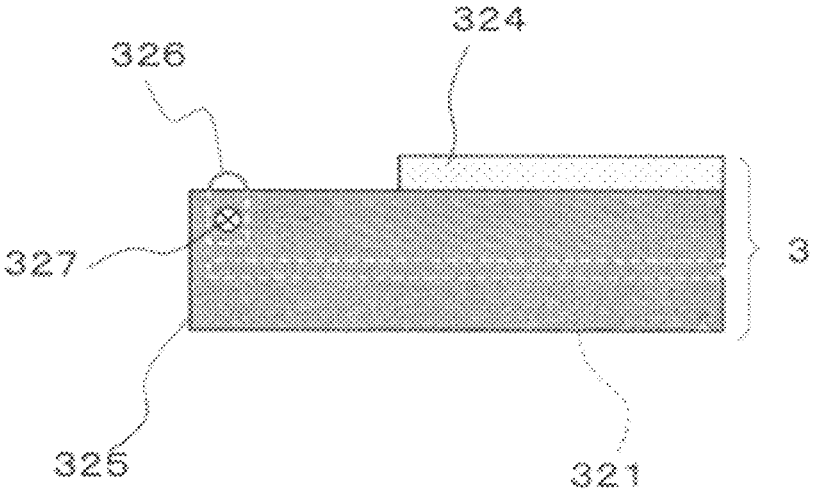
FIG. 15 is a schematic cross-sectional view illustrating an arrangement of a pin used as a spacing member of the print head of an image forming apparatus according to a tenth embodiment.

FIG. 15 illustrates the configurations of relevant portions of an image forming apparatus according to a tenth embodiment. The print head 3 (3Y, 3M, 3C, 3K) includes a light source substrate 321, a lens array 324, a holder 325, a spacing member 326, and a setscrew 327. A pin is used as the spacing member 326. By appropriately adjusting the length, by which the spacing member 326 projects, the distance between the print head 3 (3Y, 3M, 3C, 3K) and the photosensitive element 1 (1Y, 1M, 1C, 1K) in a state where the spacing member 326 abuts on the photosensitive element 1 (1Y, 1M, 1C, 1K) is adjusted; thereafter, the spacing member 326 is fastened to the print head 3 (3Y, 3M, 3C, 3K) with the setscrew 327.

Figure 20:
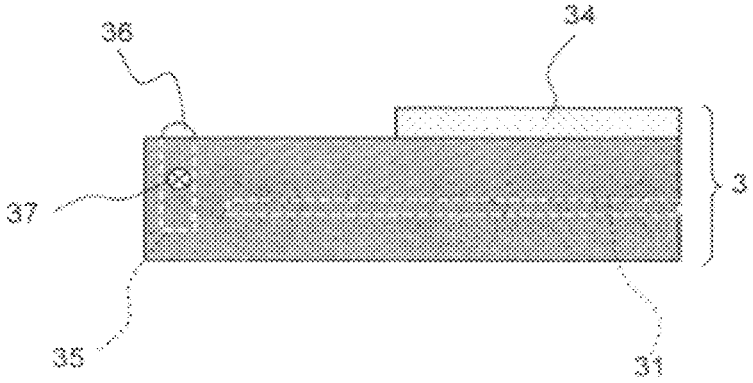
FIG. 20 is a schematic diagram illustrating an arrangement where the pin of the print head is located at a position different from that of the pin in the image forming apparatus according to the tenth embodiment.

As in the image forming apparatus according to the ninth embodiment illustrated in FIG. 14 and the image forming apparatus according to the tenth embodiment illustrated in FIG. 15, the spacing member is desirably positioned on the print head 3 (3Y, 3M, 3C, 3K) in the optical axial direction such that the spacing member 316, which is the eccentric cam illustrated in FIG. 14, or the spacing member 326, which is the pin illustrated in FIG. 15, is closer to the photosensitive element 1 (1Y, 1M, 1C, 1K) than the light source substrate 311 or 321 of the print head 3 (3Y, 3M, 3C, 3K) is. In other words, there can be a situation where, as in a configuration illustrated in FIG. 20 where in an attempt of locating a spacing member 36 farther away from the photosensitive element in the optical axial direction than a light source substrate 31 is, a portion of the spacing member 36 is located farther away from the photosensitive element than the light source substrate 31 is. In this situation, the spacing member 36 is located outside the light source substrate 31, which makes the print head 3 (3Y, 3M, 3C, 3K) undesirably long, resulting in an undesirably increase of the image forming apparatus in size.

In contrast, as illustrated in FIG. 14 or 15, when the spacing member 316 or 326 is located closer to the photosensitive element 1 (1Y, 1M, 1C, 1K) than the light source substrate 311 or 321 is, the length of the print head 3 (3Y, 3M, 3C, 3K) can be substantially equal to that of the light source substrate 311 or 321. Hence, an increase of the print head 3 (3Y, 3M, 3C, 3K) in length can be prevented.

When such an eccentric cam as illustrated in FIG. 14 is used as the spacing member 316, a configuration where the spacing member 316 is located in a V-ditch or the like cut in the holder 315 of the print head 3 (3Y, 3M, 3C, 3K) and, after the distance between the print head 3 (3Y, 3M, 3C, 3K) and the photosensitive element 1 (1Y, 1M, 1C, 1K) has been adjusted, the spacing member 316 is adhered to be fastened can be employed. When such a pin spherically shaped at its distal end as illustrated in FIG. 15 is used as the spacing member 326, a configuration where the spacing member 326 is located in a hole cut in the holder 325 of the print head 3 (3Y, 3M, 3C, 3K), and, after the distance between the print head 3 (3Y, 3M, 3C, 3K) and the photosensitive element 1 (1Y, 1M, 1C, 1K) has been adjusted by changing the length, by which the spacing member 326 projects from the holder 325, by advancing or retracting the spacing member 326, the spacing member 326 is fastened by being pressed from a lateral direction with the setscrew 327 or by adhesion can be employed.

Typically, as illustrated in FIGS. 1, 12, and the like, the developing device 4 (4Y, 4M, 4C, 4K) and the charging device 2 (2Y, 2M, 2C, 2K) are arranged around the print head 3 (3Y, 3M, 3C, 3K). The distance between the developing device 4 (4Y, 4M, 4C, 4K) and the charging device 2 (2Y, 2M, 2C, 2K) decreases toward the photosensitive element 1 (1Y, 1M, 1C, 1K), while the same increases away from the photosensitive element 1 (1Y, 1M, 1C, 1K). The print head 3 (3Y, 3M, 3C, 3K) should preferably be arranged near the photosensitive element 1 (1Y, 1M, 1C, 1K). Accordingly, in the vicinity of the photosensitive element 1 (1Y, 1M, 1C, 1K), the distance between the developing device 4 (4Y, 4M, 4C, 4K) and the charging device 2 (2Y, 2M, 2C, 2K) is slightly greater than the width of the print head 3 (3Y, 3M, 3C, 3K).

Meanwhile, a width of the cleaning member CL in the sub-scanning direction, which corresponds to the rotating direction of the photosensitive element 1 (1Y, 1M, 1C, 1K), is desirably greater than the width of the print head 3 (3Y, 3M, 3C, 3K). If the width of the cleaning member CL is smaller than the width of the print head 3 (3Y, 3M, 3C, 3K), the cleaning member CL can contact the photosensitive element 1 (1Y, 1M, 1C, 1K) during cleaning and damage the photosensitive element 1 (1Y, 1M, 1C, 1K), which is undesirable. In contrast, if the width of the cleaning member CL is greater than the width of the print head 3 (3Y, 3M, 3C, 3K), when the cleaning member CL approaches the photosensitive element 1 (1Y, 1M, 1C, 1K) during cleaning, the cleaning member CL tends to contact the charging device 2 (2Y, 2M, 2C, 2K) or the developing device 4 (4Y, 4M, 4C, 4K), which in turn causes the cleaning member CL to less likely to contact the photosensitive element 1 (1Y, 1M, 1C, 1K). Hence, this protects the photosensitive element 1 (1Y, 1M, 1C, 1K) from being damaged by the cleaning member CL.

An image forming apparatus according to an eleventh embodiment is described below with reference to FIGS. 16 and 17.

Figure 16:
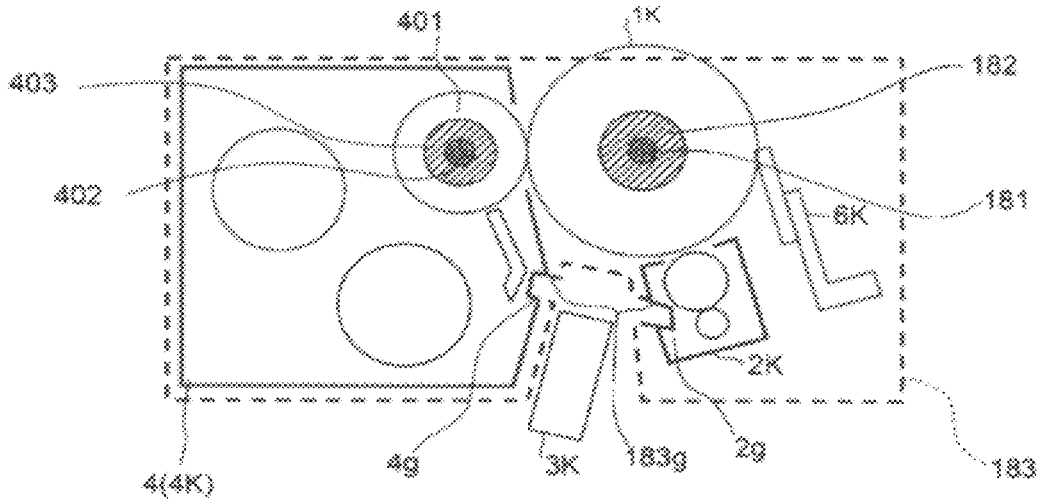
FIG. 16 is a schematic diagram illustrating a layout of units near and around the photosensitive element of an image forming apparatus according to an eleventh embodiment in a state where a cleaning member is not inserted into guiding portions provided to receive the cleaning member inserted between a developing device and a charging device.
Figure 17:
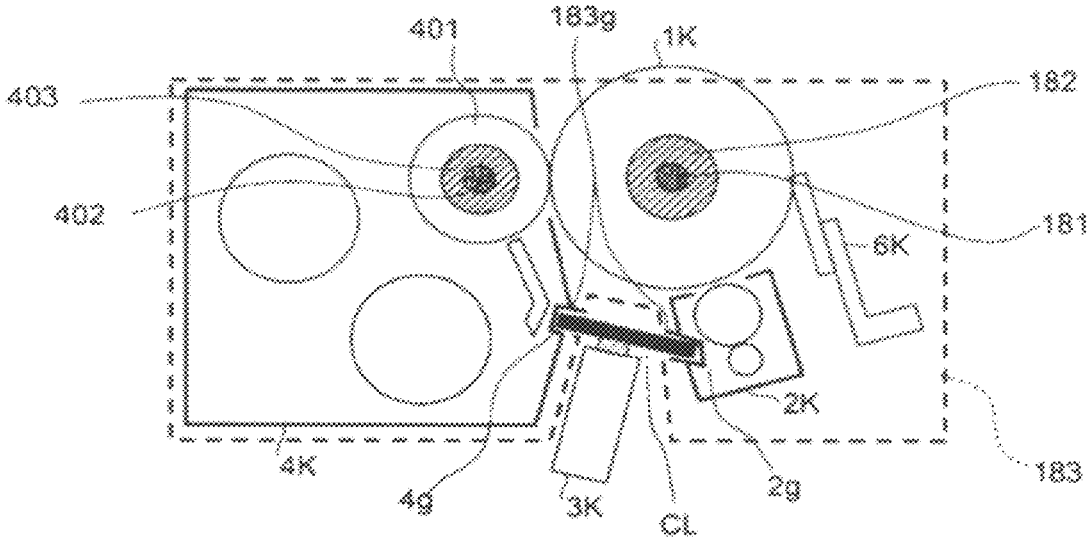
FIG. 17 is a schematic diagram illustrating a layout of units near and around the photosensitive element of the image forming apparatus illustrated in FIG. 16 in a state where the cleaning member has been inserted into the guiding portions provided to receive the cleaning member inserted between the developing device and the charging device.

FIGS. 16 and 17 schematically illustrate layouts of units near and around the photosensitive element 1 (1Y, 1M, 1C, 1K) of the image forming apparatus according to the eleventh embodiment. FIG. 16 illustrates a state where the cleaning member CL is not inserted. FIG. 17 illustrates a state where the cleaning member CL has been inserted. Each of FIGS. 16 and 17 schematically depicts the configuration of one station (e.g., the station for black (K)) of the stations illustrated in FIG. 1 in detail. The other stations are similar thereto in configuration and configured as is the station illustrated in FIGS. 16 and 17.

A rotating shaft 181 of the drum-shaped photosensitive element 1 (1K) is supported by a shaft bearing member 182. The shaft bearing member 182 is supported by a shaft-bearing holding member 183 having such a shape as indicated by broken line in FIGS. 16 and 17.

Thus, a photosensitive element unit includes at least the drum-shaped photosensitive element 1 (1K). The photosensitive element unit includes the photosensitive element 1 (1K), the rotating shaft 181 of the photosensitive element, the shaft bearing member 182 of the photosensitive element, the shaft-bearing holding member 183, and the developing device 4 (4K). The developing device 4 (4K) includes the developing roller 401, the rotating shaft 402 of the developing roller, and the shaft bearing member 403 of the developing roller. The shaft bearing member 403 of the developing roller that rotatably supports the rotating shaft 402 of the developing roller is also supported by the shaft-bearing holding member 183. The photosensitive element 1 (1K) integrally rotates with the rotating shaft 181 of the photosensitive element. The shaft bearing member 182 of the photosensitive element is fastened to the shaft-bearing holding member 183.

As illustrated in FIGS. 16 and 17, in the eleventh embodiment, a guiding portion 183*g*, a guiding portion 2*g*, and a guiding portion 4*g* for use in inserting the cleaning member CL to a correct position are provided on the shaft-bearing holding member 183, a cover of the charging device 2 (2K), and a cover of the developing device 4 (4K), respectively.

FIG. 16 illustrates a layout around the photosensitive element 1 (1K) in a state where the print head 3 (3K) is at a retracted position. The guiding portion 2*g* and the guiding portion 4*g* are provided such that a notch, serving as the guiding portion 2*g*, is defined in the cover of the charging device 2 (2K) and a notch, serving as the guiding portion 4*g*, is defined in the cover of the developing device 4 (4K). When these guiding portions 2*g* and 4*g* are provided, the cleaning member CL can be inserted into the correct position as illustrated in FIG. 17. A portion of the cleaning member CL is, for instance, an elastic member for use in cleaning the surface of the lens array. As illustrated in FIGS. 16 and 17, when the guiding portions 2*g* and 4*g* in the covers of the charging device 2 (2K) and the developing device 4 (4K) are provided, the cleaning member CL is prevented altogether from contacting the photosensitive element 1 (1K) when the cleaning member CL is inserted for cleaning. In the configuration illustrated in FIGS. 16 and 17, each of the charging device 2 (2K) and the developing device 4 (4K) includes a corresponding one of the guiding portions 2*g* and 4*g*. However, another configuration, in which only one of the guiding portion 2*g* of the charging device 2 (2K) and the guiding portion 4*g* of the developing device 4 (4K) is provided, can be employed.

In the example illustrated in FIGS. 16 and 17, the guiding portion 183*g*, which is a notch, conforming to the guiding portion 2*g* of the charging device 2 (2K) and the guiding portion 4*g* of the developing device 4 (4K) is also provided. As a matter of course, this configuration is more desirable.

Figure 18:
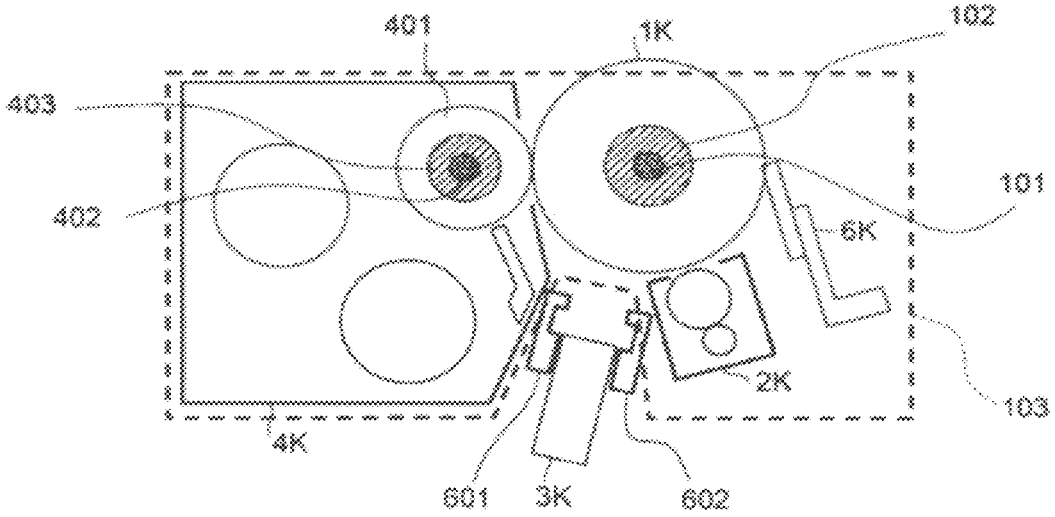
FIG. 18 is a schematic diagram illustrating a layout of units near and around the photosensitive element of an image forming apparatus according to a twelfth embodiment in a state where the cleaning member is not inserted into guiding portions formed with guiding members that form the guiding portions between the developing device and the charging device and between the charging device and the print head to receive the cleaning member inserted therebetween.

In the above discussion, the guiding portions 2*g* and 4*g* are provided in the covers of the charging device 2 (2K) and the developing device 4 (4K); however, in an image forming apparatus according to a twelfth embodiment illustrated in FIG. 18, a guiding member 601 and a guiding member 602 are provided between the charging device 2 (2K) and the print head 3 (3K) and between the developing device 4 (4K) and the print head 3 (3K), respectively. In the configuration illustrated in FIG. 18, the guiding member 601 and the guiding member 602 are provided between the charging device 2 (2K) and the print head 3 (3K) and between the developing device 4 (4K) and the print head 3 (3K), respectively. However, another configuration, in which any one of the guiding member 601 between the charging device 2 (2K) and the print head 3 (3K) and the guiding member 602 between the developing device 4 (4K) and the print head 3 (3K) is provided, can be employed.

As discussed earlier, when the photosensitive element unit is configured can be drawn, it is difficult to align the stations for the different colors in the main-scanning direction (direction parallel to the rotating shaft of the photosensitive element) and in the sub-scanning direction (direction, in which the photosensitive element rotates) with high accuracy. Accordingly, when the position of the print head 3 is restricted in the main-scanning direction and in the sub-scanning direction by the photosensitive element unit, the print heads 3 of the different stations can be misaligned, which undesirably results in color misregistration. The degree of misalignment tends to be large particularly in the main-scanning direction. Hence, positions of the print heads 3 are desirably restricted by the image forming apparatus body rather than by the photosensitive element units at least in the main-scanning direction. More desirably, the positions of the print heads 3 are restricted by the image forming apparatus body rather than by the photosensitive unit both in the main-scanning direction and in the sub-scanning direction.

Furthermore, it is desirable that one of a contacting portion (e.g., the spacing member 326), at which the print head 3 contacts the photosensitive element unit, of the print head 3 serving as the exposing unit and a contacting portion (e.g., the shaft-bearing holding member 103), at which the photosensitive element unit contacts the print head 3, of the photosensitive element unit is a curved surface and the other one is a flat surface. This configuration prevents the position of the print head 3 from being restricted by the photosensitive element unit in at least one of the main-scanning direction and the sub-scanning direction, thereby preventing color misregistration that results from misalignment of the photosensitive element units discussed above. Examples of the curved surface include a cylindrical surface and an elliptic cylindrical surface.

The position of the print head 3 in the main-scanning direction and in the sub-scanning direction is desirably restricted by a main-scanning-direction-position restricting member and a sub-scanning-direction-position restricting member provided on the image forming apparatus body. It is desirable to use at least one of the main-scanning-direction-position restricting member and the sub-scanning-direction-position restricting member. It is more desirable to use both the main-scanning-direction-position restricting member and the sub-scanning-direction-position restricting member. A single member that functions as both the main-scanning-direction-position restricting member and the sub-scanning-direction-position restricting member can be employed.

Figure 19:
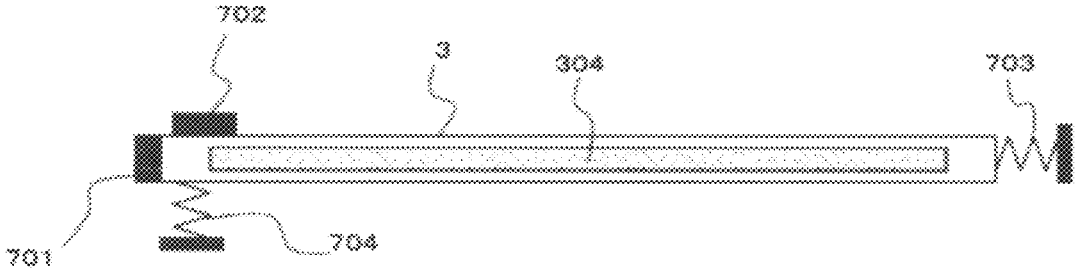
FIG. 19 is a schematic diagram depicting the configuration near the print head, the diagram illustrating how a position of the print head of an image forming apparatus according to a thirteenth embodiment is restricted in the main-scanning direction and the sub-scanning direction by a main-scanning-direction-position restricting member for restricting the position in the main-scanning direction and a sub-scanning-direction-position restricting member for restricting the position in the sub-scanning direction.

FIG. 19 illustrates the configurations of relevant portions of an image forming apparatus that includes both the main-scanning-direction-position restricting member and the sub-scanning-direction-position restricting member according to a thirteenth embodiment.

Referring to FIG. 19, a main-scanning-direction-position restricting member 701 and a sub-scanning-direction-position restricting member 702 are provided on the image forming apparatus body at a position corresponding to a side surface of the print head 3 in the main-scanning direction and a position corresponding to a side surface of the print head 3 in the sub-scanning direction, respectively. A pressing member 703 and a pressing member 704 are provided on the image forming apparatus body at a portion confronting the main-scanning-direction-position restricting member 701 and a portion confronting the sub-scanning-direction-position restricting member 702, respectively, so that the print head 3 is pressed against the main-scanning-direction-position restricting member 701 and the sub-scanning-direction-position restricting member 702. The main-scanning-direction-position restricting member 701 and the sub-scanning-direction-position restricting member 702 can be, for instance, a plate-like member, a pin that is spherically shaped at its distal end, or the like member. At least any one of the scanning-direction-position restricting member and the sub-scanning-direction-position restricting member can be configured to come into contact with a side surface of a light-source-substrate holding member that holds the light source substrate of the exposing unit, thereby performing positional restriction.

According to an aspect, an image forming apparatus, with use of a print-head-type exposing unit, capable of holding an image carrier and an exposing unit at a given distance from each other with high accuracy and also easy in cleaning a surface of a lens array of the exposing unit is provided.

More specifically, the image forming apparatus is capable of holding the image carrier and the exposing unit at the given distance from each other with high accuracy. Furthermore, in the image forming apparatus, the surface of the lens array of the exposing unit can be cleaned easily because a mechanism for holding the image carrier and the exposing unit at the given distance does not interfere with the cleaning. The image forming apparatus can be constructed compact because a retraction amount of the exposing unit at mounting and dismounting of the image carrier is small.

According to another aspect of the invention, the image carrier and the exposing unit can be held at a given distance from each other particularly with high accuracy with an appropriate and simple configuration.

In particular, the developing unit and the image carrier can be maintained at the given distance from each other stably with high accuracy. This allows high quality images free from inconsistencies in density to be formed.

According to still another aspect of the invention, the developing unit and the image carrier can be set at a given distance from each other particularly with high accuracy. This allows high quality images to be provided.

According to still another aspect of the invention, even when a spacing member is provided, an increase of the exposing unit in length is prevented, thereby preventing an increase of the apparatus in overall depth dimensions.

According to still another aspect of the invention, the image carrier is particularly less likely damaged by contact with the cleaning member.

According to still another aspect of the invention, contact between the cleaning member and the image carrier is effectively prevented.

According to still another aspect of the invention, misalignment of images being formed, which can result in color misregistration or the like, can be reduced without depending on positional accuracy of image carrier units.

According to still another aspect of the invention, irrespective of positional accuracy of the image carrier units, the image carrier and the exposing unit can be set at a given distance from each other with high accuracy, thereby effectively reducing misalignment, which can result in color misregistration or the like, of images being formed.

According to still another aspect of the invention, the image carrier and the exposing unit can be set at a given distance from each other particularly with high accuracy, thereby more effectively reducing misalignment, which can result in color misregistration or the like, of images being formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier unit including a cylindrical image carrier having a rotational driving shaft rotated about a cylinder axis, a shaft bearing member that rotatably supports the image carrier, and a shaft-bearing holding member that holds the shaft bearing member;

a charging unit for charging the image carrier, thereby causing the image carrier to be charged;

an exposing unit for forming an electrostatic latent image on the image carrier charged by the charging unit, the exposing unit including a light source substrate that includes light sources arranged in at least one line and a lens array that guides light emitted from the light sources;

a developing unit for developing the electrostatic latent image on the image carrier formed by the exposing unit with toner;

a transfer unit for transferring the image developed on the image carrier onto an image recording medium; and a fixing unit for fixing the image transferred by the transfer unit onto the recording medium, wherein the exposing unit is movable between a contacting position, at which the exposing unit is supported by an image forming apparatus body and the exposing unit comes into contact with a contacting surface on the shaft-bearing holding member-of the image carrier unit to be positioned at a predetermined position relative to the image carrier, and a retracted position, at which the exposing unit is away from the image carrier unit, and the contacting surface of the image carrier unit at the contacting position is closer to the exposing unit in an optical axial direction than is a surface of the lens array.

2. The image forming apparatus of claim 1, wherein the image carrier unit supports the developing unit.

3. The image forming apparatus of claim 1, wherein the exposing unit includes a spacing member, with which a distance between the exposing unit and the image carrier is adjustable, and a contacting portion, at which the exposing unit abuts on the contacting surface of the image carrier unit, of the exposing unit is located on the spacing member.

4. The image forming apparatus of claim 3, wherein the spacing member is arranged on the exposing unit at a position closer to the image carrier in the optical axial direction than the light source substrate is.

5. The image forming apparatus of claim 1, further comprising a cleaning member for cleaning the surface of the lens array of the exposing unit, wherein when a direction parallel to the rotational driving shaft of the image carrier is referred to as a main-scanning direction, while a direction orthogonal to both the optical axial direction and the main-scanning direction is referred to as a sub-scanning direction, a width in the sub-scanning direction of the cleaning member is greater than a width in the sub-scanning direction of the surface of the lens array of the exposing unit.

6. The image forming apparatus of claim 5, further comprising a guiding portion provided in at least any one of a portion of the charging unit and a portion of the developing unit, the guiding portion guiding the cleaning member to allow the cleaning member to clean the surface of the lens array.

7. The image forming apparatus of claim 5, further comprising a guiding portion provided at least any one of between the exposing unit and the charging unit and between the exposing unit and the developing unit, the guiding portion guiding the cleaning member to allow the cleaning member to clean the surface of the lens array.

8. The image forming apparatus of claim 1, further comprising a cleaning member for cleaning the surface of the lens array of the exposing unit, wherein the shaft-bearing holding member includes a guiding portion that guides, when the exposing unit is at the retracted position, the cleaning member so that the cleaning member is inserted between the developing unit and the exposing unit to clean the surface of the lens array.

9. The image forming apparatus of claim 1, wherein when a direction parallel to the rotational driving shaft of the image carrier is referred to as a main-scanning direction, while a direction orthogonal to both the optical axial direction and the main-scanning direction is referred to as a sub-scanning direction, at the contacting position, the image carrier unit does not restrict a position of the exposing unit at least in the main-scanning direction.

10. The image forming apparatus of claim 9, wherein when the direction parallel to the rotational driving shaft of the image carrier is referred to as the main-scanning direction, while the direction orthogonal to both the optical axial direction and the main-scanning direction is referred to as the sub-scanning direction, at least any one of a main-scanning-direction-position restricting member that restricts the position of the exposing unit in the main-scanning direction and a sub-scanning-direction-position restricting member that restricts the position of the exposing unit in the sub-scanning direction is provided on the image forming apparatus body.

11. The image forming apparatus of claim 10, wherein at least any one of the main-scanning-direction-position restricting member and the sub-scanning-direction-position restricting member comes into contact with a side surface of a light-source-substrate holding member that holds the light source substrate of the exposing unit, thereby restricting the position of the exposing unit.

12. The image forming apparatus of claim 1, wherein one of a contacting portion, at which the exposing unit contacts the image carrier unit, of the exposing unit and the contacting surface of the image carrier unit is a curved surface and other one of the contacting portion and the contacting surface is a flat surface.

* * * * *